United States Patent [19]

McClish

[11] Patent Number: 4,856,401

[45] Date of Patent: Aug. 15, 1989

[54] SUB-HARMONIC TONE GENERATOR FOR BOWED MUSICAL INSTRUMENTS

[76] Inventor: Richard E. D. McClish, 2200 Chapdelaine Apt. 1203, Ste-Foy, Quebec, Canada, G1V-4G8

[21] Appl. No.: 92,085

[22] Filed: Sep. 2, 1987

[51] Int. Cl.[4] ..... G10H 3/12; G10H 1/06

[52] U.S. Cl. ..... 84/1.11; 84/1.16; 84/1.23

[58] Field of Search ..... 84/1.04–1.16, 84/1.19–1.23, 256, 274, 453

[56] References Cited

U.S. PATENT DOCUMENTS

| | | | |
|---|---|---|---|
| Re. 26,533 | 3/1969 | Cookerly et al. | 84/1.16 |
| 3,097,253 | 7/1963 | Peterson | 84/1.12 X |
| 3,535,969 | 10/1970 | Bunger | 84/1.11 |
| 3,934,201 | 1/1976 | Majefski | 84/1.24 X |
| 4,442,750 | 4/1984 | Bowley | 84/1.24 X |
| 4,534,258 | 8/1985 | Anderson | 84/1.16 X |
| 4,730,530 | 3/1988 | Bonanno | 84/1.16 |

*Primary Examiner*—Arthur T. Grimley
*Assistant Examiner*—John G. Smith

[57] ABSTRACT

A device to produce sub-harmonic tone signals in response to a tone signal from a transducer having preferably maximum sensitivity in the plane of bowing of a bowed musical instrument by passing selected cycles of the transducer signal through signal gates which are controlled jointly by sub-harmonic control signals at sub-multiples of the fundamental frequency of the transducer signal and by a signal indicative of the detection of a fundamental frequency. Each sub-harmonic tone signal thus produced has a tone color which approximates that of the corresponding bowed musical instrument of the same frequency range and which is independent of the direction of bowing.

10 Claims, 2 Drawing Sheets

SUB-HARMONIC TONE GENERATOR FOR BOWED MUSICAL INSTRUMENTS

TECHNICAL FIELD

This invention relates to tone processing systems and more specifically to devices which can produce sub-multiple frequencies of a tone signal from a musical instrument.

BACKGROUND ART

Devices which create sub-harmonic tones in response to the tone signal of a musical instrument are known in the prior art.

U.S. Pat. No

U.S. Pat. No. 3,535,969 issued to Bunger describes one such deivce which uses transmission gates each controlled by a frequency divider to produce sub-harmonic voices which are accurately proportional in amplitude and in tone color to those of the incoming tone signal.

In such a device, the phase relationship between the tone signal being gated and the control voltage from the frequency divider is assumed to be rather constant.

A problem exists when a tone signal from a transducer monitoring the displacements of a bowed vibrating element in and about the plane of bowing is gated to produce a sub-harmonic tone, that the tone color of the sub-harmonic tone will change upon a change in the direction of bowing although the tone color of the signal from the transducer remains constant for both bowing directions.

This undesirable change in the tone color of the sub-harmonic tone signal occurs because the phase relationship between the tone signal from the transducer and the control signal driving the gate changes upon a change in the direction of bowing.

The waveform of the tone signal from the transcducer is asymmetrical and reverses when the direction of bowing is reversed. When the transducer signal is applied to a comparator to produce a square wave at the frequency of the note being played, the pulse width of the resulting square wave will change significantly upon a change in the direction of bowing, causing a corresponding time shift in the triggering of the divider.

A second problem exists when the sub-harmonic tone signals are partially formed of out-of-phase portions of the transducer signal, that when such a sub-harmonic tone signal is mixed with the corresponding transducer signal, the out-of-phase portions of the sub-harmonic tone signal tend to cancel the corresponding in-phase portions of the transducer signal, thus partially defeating the efforts to produce a sub-harmonic signal in that manner.

A third problem exists if the signal gates are left in a state of conduction when the fundamental detector is inactive, that the entire transducer signal will be passed when the level of a decaying tone becomes lower than that required to activate the fundamental detector. This problem is much more noticeable with bowed instruments than it is with wind instruments.

It is therefore a first object of the present invention to provide an improvement in sub-harmonic tone generators of the signal gating type, whereby the tone color of the resulting subharmonic tone signal is independent of the direction of bowing.

It is a second object of the present invention to produce sub-harmonic tone signals which can be mixed in any ratio with the tone signal from the originating transducer and also with other sub-harmonic tone signals from the same transducer signal without causing any cancellation between them.

It is a third object of the present invention to prevent the passing of any portion of the transducer signal through the sub-harmonic generating signal gates in the absence of detection of the fundamental frequency of the played note.

It is a fourth object of the present invention to produce sub-harmonic tone signals, the waveforms of which closely approximate those of the corresponding bowed instruments of the same frequency range.

SUMMARY OF THE INVENTION

According to the invention, a signal from a transducer monitoring the displacements of a bowed vibrating element in and about the plane of bowing is applied to an anti-aliasing high-pass filter having its cutoff frequency slightly below the fundamental frequency of the lowest played note to be monitored by the transducer. This filtering is performed to remove any low-frequency transient which may occur upon a change in the direction of bowing or which may come as a result of plucking a vibrating element instead of bowing it.

A singular possibility exists if the tone signal of a bowed instrument is high-passed in the manner mentioned above: the resulting waveform has a special shape which allows the creation of a sub-harmonic waveform similar in nature to the waveform of the corresponding bowed instruments having the same frequency range, using a single transmission gate to remove portions of the signal.

Thus, by passing a bowed violin signal through a single transmission gate, it is possible to produce a tone signal which closely approximates that of a bowed cello. It is also possible to pass the same violin signal through a second transmission gate and produce a tone signal which closely approximates that of a bowed string bass. The three signals can be mixed in any ratio without creating any cancellation between them since no portion of the sub-harmonic signals contain any out-of-phase components of the transducer signal.

In order to produce such sub-harmonic signals, the filtered transducer signal is applied to a fundamental frequency detector which produces a square wave at the frequency of the note being played. The waveform of this fundamental frequency square wave resembles a series of narrow pulses each corresponding to a cycle of the tone. The polarlity of these pulses changes according to the direction of bowing.

The fundamental frequency square wave is applied to an averager to produce a voltage indicative of the direction of bowing. This indicate voltage is applied to a voltage comparator to produce a logic signal indicative of the direction of bowing. The fundamental frequency square wave is also applied to a follower/inverter circuit which inserts a logic inverter in series with the fundamental frequency square wave in response to a signal indicative of the direction of bowing, so that the pulses appearing at the output of the follower/inverter circuit are always of the same polarlity, irrespecitvely of the direction of bowing.

The logic signal indicative of the direction of bowing is latched shortly after the beginning of a played note to avoid erratic operation of the inverter/follower circuit at the end of a bowed note or when a note is plucked.

This is done using a data latch which stores the logic signal indicative of the direction of bowing in response to a signal from a detector monitoring the presence of pulses in the fundamental frequency square wave.

The pulse signal from the output of the follower/inverter circuit is applied to a first frequency divider to produce a first sub-harmonic square wave having approximately 50% of pulse width at one half the frequency of the pulse signal from the follower/inverter circuit.

The sub-harmonic square wave from the first frequency divider is applied to a second frequency divider to produce a sub-harmonic square wave having about 50% of pulse width at one quarter the frequency of the pulse signal from the follower/inverter circuit.

The output signals from both dividers are applied to a logic AND gate to produce a composite sub-harmonic square wave having about 25% of pulse width at one quarter the frequency of the pulse signal from the follower/inverter circuit.

In addition to being applied to the fundamental frequency detector, the filtered transducer signal is also applied to a pair of audio signal transmission gates, the state of conduction of which are respectively controlled by the above-mentioned sub-harmonic square waves. To produce a cello sound, a first gate is controlled by the first sub-harmonic square wave. To produce a bowed string bass sound, a second gate is controlled by the second sub-harmonic square wave.

The cello and bass tone signals are both composed only of in-phase portions of the violin signal and therefore can be mixed together and with the violin signal in any ration without producing any cancellation in any of the mixed tone signals.

To ensure that only sub-harmonic tone signals will be generated, both audio signal gates are kept in the OFF state in the absence of a gate enabling signal from a detector monitoring the presence of pulses in the fundamental signal from the fundamental frequency detector.

Since the pulses from the follower/inverter circuit are all of the same polarity, irrespectively of the direction of bowing, the operation of the frequency dividers is always in a similar phase relationship with respect to each cycle of the transducer signal applied to the signal tranmsission gates, and the tone color of the sub-harmonic tone signals thus produced will be the same for both directions of bowing.

The above and still further objects, features and advantages of the present invention will become apparent upon consideration of the following detailed description of a specific embodiment thereof, especially when taken in conjunction with the accompanying drawings wherein:

DETAILED DESCRIPTION OF THE PREFERRED EMBODIMENT

Figure 1:
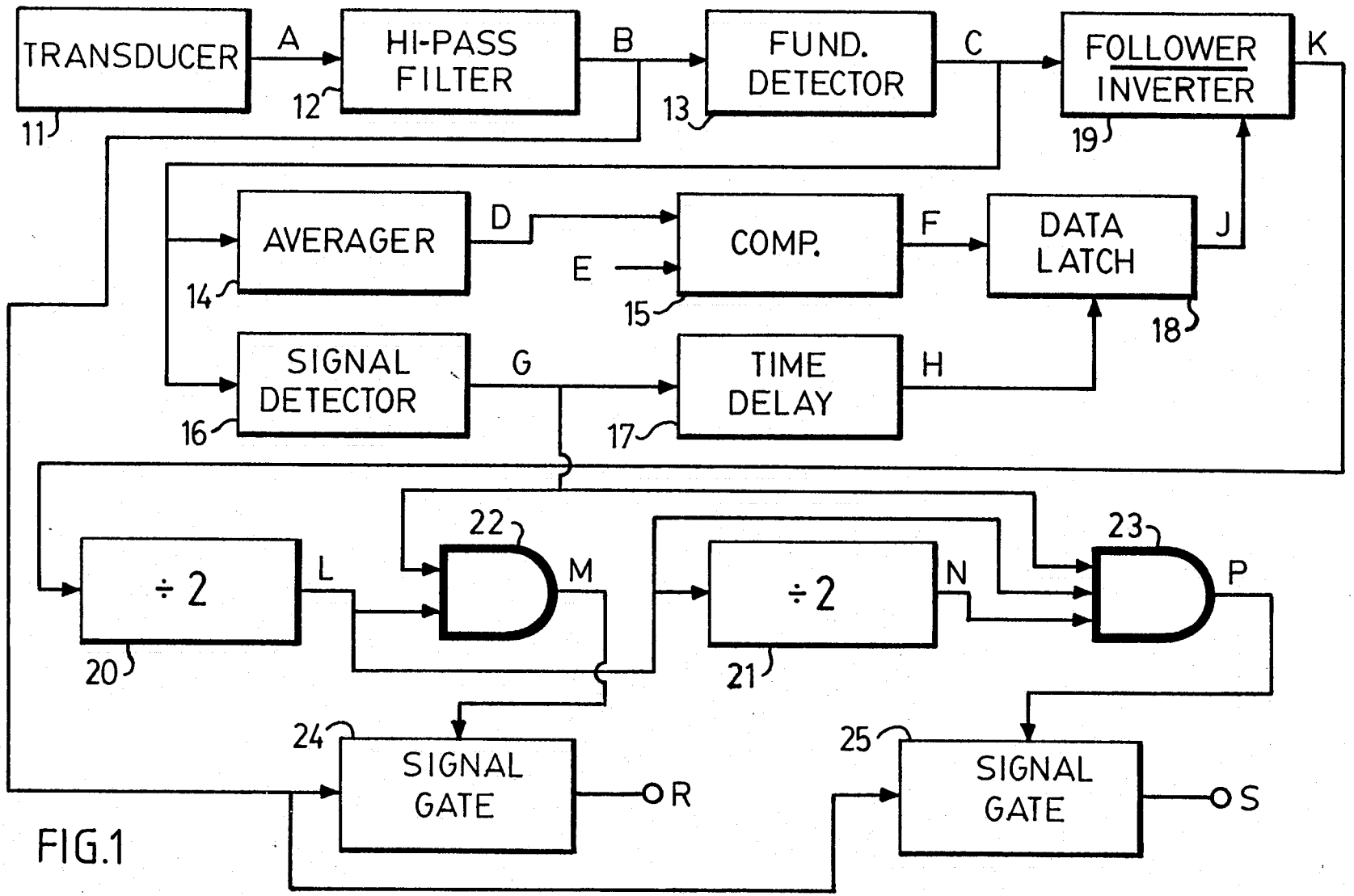
FIG. 1 is a block diagram of an apparatus according to the present invention.

Referring now to FIG.1 of the drawings, a transducer 11 monitoring the displacements of a bowed vibrating element in and about the plane of bowing produces a tone signal A, illustrated in FIG. 2A, which is applied to an anti-aliasing high-pass filter 12 having its cutoff frequency slightly below that of the lowest played note to be monitored by the transducer. This filtering does not significantly affect the tone color of the bowed note but eliminates spurious low frequency components occuring in the transducer signal as a result of a change in the direction of bowing or as a result of plucking a note instead of bowing it.

The high-pass filter 12 produces a tone signal B, illustrated in FIG. 2B, the waveform of which exhibits peaks of unequal amplitude and of opposite polarity. The largest peak in each cycle of the tone signal B corresponds to the most rapid voltage change in each corresponding cycle of the transducer signal A.

Figure 2:
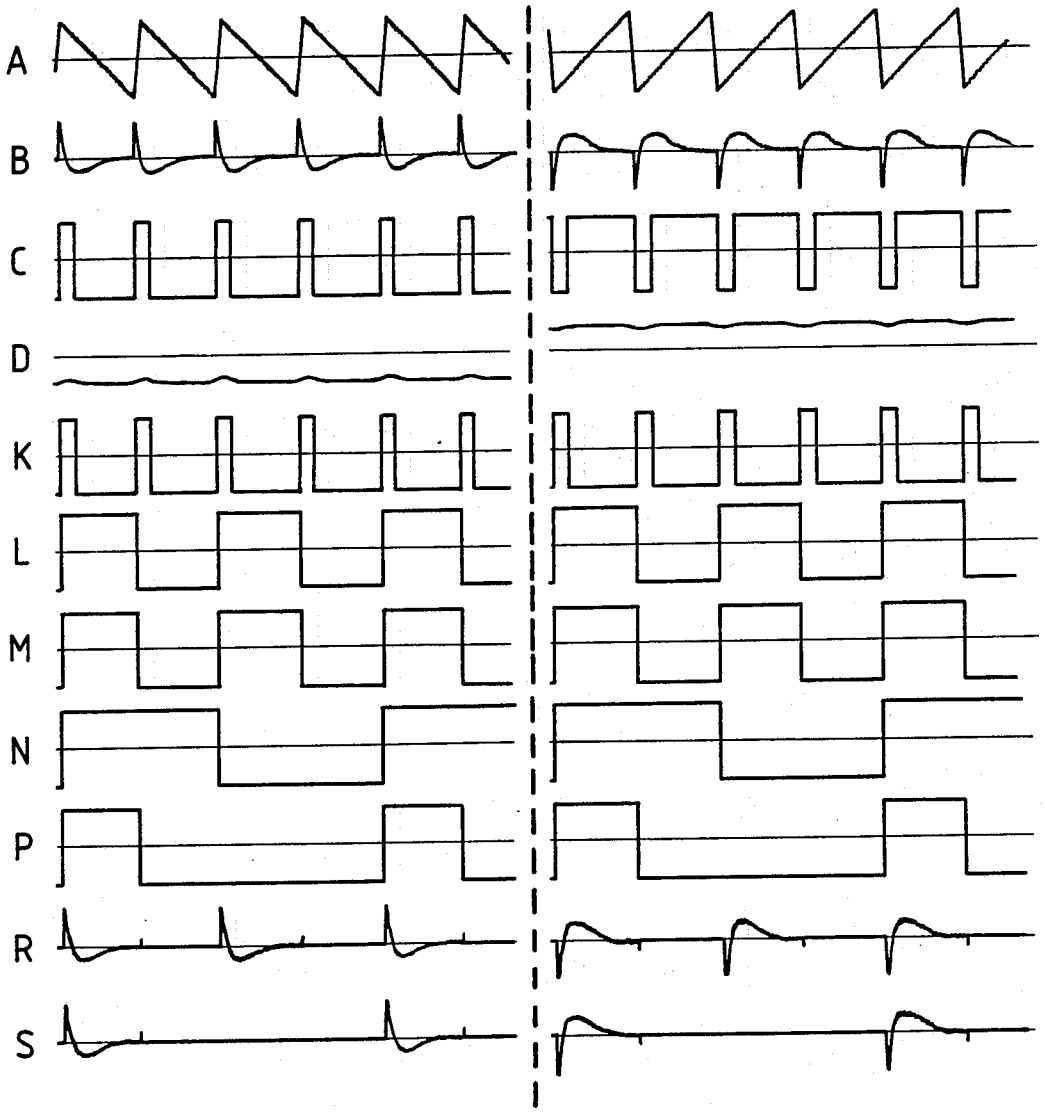
FIGS. 2A through 2M are plots of signal waveforms appearing at designated points in the apparatus of FIG. 1.

In FIG. 2, the plots of waveforms in the left column are time-aligned and relate to one direction of bowing while those in the right column are also time-aligned but relate to the opposite direction of bowing.

The tone signal B is applied to a fundamental frequency detector 13 to produce a fundamental square wave C, illustrated in FIG. 2C. It can be seen in FIGS. 2A through 2C that the three waveforms A, B and C become inverted upon a change in the direction of bowing. This characteristic of these waveforms is independent of which note is being played. The fundamental square wave C is applied to an averager 14 to produce a voltage D, illustrated in FIG. 2D, which changes according to the direction of bowing. Voltage D is applied to a first input of a voltage comparator 15 while the second input thereof is connected to a reference voltage E so that the logic signal F appearing at the output of the comparator 15 will change in response to a change in the direction of bowing.

Since the indicative signal F may become unstable when the vibrating element is left vibrating freely at the end of a bow stroke, the signal F is stored in response to a signal indicative of activity in the fundamental detector 13. Thus, the indication of the direction of bowing is made stable for the entire duration of a played note.

For this purpose, the signal F, indicative of the direction of bowing, is applied to a data latch 18 to produce a stored indicative signal J indicative of the direction of bowing for the entire duration of the played note. The data latch 18 is activated by the delayed signal H, obtained by applying the fundamental square wave C to a signal detector 16 producing an activity signal G, and by slightly delaying signal G with a delay network 17 to ensure that the indicative signal F is stable before the data latch 18 is activated.

The fundamental square wave C is also applied to a follower/inverter circuit 19 which selectively inverts the square wave C in response to a given state of the stored indicative signal J from the data latch 18. The follower/inverter 19 produces a square wave K, illustrated in FIG. 2K, the pulses of which are all of the same polarity, irrespectively of the direction of bowing.

The square wave K is applied to a first frequency divider 20 to produce a first sub-harmonic square wave L, illustrated in FIG. 2L, having a pulse width of approximately 50% at one half the frequency of the sqaure wave K.

In addition to being applied to the fundamental frequency detector 13, the filtered transducer signal B is applied to the audio input of a first signal transmission gate 24, the state of conduction of which is controlled by a first gate enabling signal M, illustrated in FIG. 2M, from a first logic AND gate 22 which is activated by the first sub-harmonic square wave L from the first divider 20 and by the activity signal G from the signal detector 16. This ensures that the gate 24 will remain in a non-conducting state when no pulses are detected in the fundamental signal C and that the first sub-harmonic square wave L will control the state of conduction of the gate 24 for as long as there is detected activity in the fundamental frequency detector 13. The signal transmission gate 24 produces a first sub-harmonic tone signal R, illustrated in FIG. 2R, the tone color and the amplitude of which are accurately proportional to those of the transducer signal A and independent of the direction of bowing.

The sub-harmonic square wave L from the first frequency divider 20 is also applied to a second frequency divider 21 to produce a second sub-harmonic square wave N, illustrated in FIG. 2N, having a pulse width of approximately 50% at one quarter the frequency of the square wave K.

The activity signal G and the two sub-harmonic square waves L and N are connected to the inputs of a second logic AND gate 23 to produce a second gate enabling signal P, ilustrated in FIG. 2P, having about 25% of pulse width at one quarter the frequency of the square wave K. This ensures that the gate 25 will remain in a non-conducting state when no pulses are detected in the fundamental signal C and that the combination of the two sub-harmonic square waves L and N will control the state of conduction of the gate 25 for as long as there is detected activity in the fundamental frequency detector 13. The signal transmission gate 25 produces a second sub-harmonic tone signal S, illustrated in FIG. 2S, the tone color and the amplitude of which are accurately proportional to those of the transducer signal A and indpedent of the direction of bowing.

As it can be seen in FIG. 2 by comparing the waveforms of the sub-harmonic tone signals R and S with the filtered transducer signal B, there is a close resemblance between them with respect to their asymmetrical shape. The three signals B, R and S can be mixed together in any ratio and the coincident cycles will be reinforced; in this way, the tone signals are truly additive since all of their peaks are in-phase.

APPLICABILITY

To obtain the best results from an apparatus of this invention with a violin, it is preferable to monitor each string separately using individual transducers and to feed the separate transducer signals to a corresponding number of individual detection, division and gating arrangements.

The separate sub-harmonic tone signals thus produced can then be sub-grouped into a polyphonic cello tone signal and a polyphonic bass violin tone signal. These tone siganls can then be filtered to taste and mixed with the transducer signal if so desired. The sub-harmonic voices may also be processed, recorded or amplified separately, as desired.

While a specific embodiment of the present invention was described and illustrated, it is clear that the use of similar functions in another form for the purpose intended here does not depart from the true spirit and scope of this invention as described in the appended claim.

What is claimed is:

1. A sub-harmonic tone generator for a bowed musical instrument having at least one vibrating element which is bowed in more than one direction of bowing, said sub-harmonic tone generator comprising:

transducer means responsive to vibrations of a bowed vibrating element in a plane determined by a direction of bowing and producing a transducer signal, fundamental frequency detection means responsive to a fundamental frequency of said transducer signal and producing a signal indicative of said fundamental frequency, means to produce a signal indicative of the direction of said bowing.

frequency divider means producing a sub-harmonic control signal at a sub-multiple of said fundamental frequency of said transducer signal, means responsive to said signal indicative of the direction of said bowing for maintaining a constant phase relationship between said transducer signal and said sub-harmonic control signal, irrespective of the direction of said bowing, and transducer signal gating means responsive to said sub-harmonic control signal and producing a sub-harmonic transducer signal at said sub-multiple of said fundamental frequency of said transducer signal, whereby said sub-harmonic transducer siganl has a tone color which is effectively independent of the direction of said bowing.

2. The sub-harmonic tone generator of claim 1 wherein said means for maintaining said constant phase relationship comprises means to maintain a constant phase relationship between said transducer signal and said signal indicative of said fundamental frequency of said transducer signal.

3. The sub-harmonic tone generator of claim 1 wherein said transducer signal and said sub-harmonic transducer signal may be combined in any ratio without mutually cancelling each other.

4. The sub-harmonic tone generator of claim 1 further comprising high-pass filter means for producing a filtered transducer signal, whereby said transducer signal gating means produces a filtered sub-harmonic transudcer signal emulative of a tone signal produced by a musical instrument other than said bowed musical instrument and having a frequency range lower than said transducer signal and determined by said sub-multiple of said fundamental frequency of said transducer signal.

5. The sub-harmonic tone generator of claim 1 further comprising:

means responsive to said transducer signal for producing a gate-enabling signal, and means to control said transducer signal gating means with said sub-harmonic control signal and said gate enabling signal, whereby said transducer signal gating means produces only said sub-harmonic transducer signal.

6. A sub-harmonic tone generator for a bowed musical instrument having at least one vibrating element which is bowed in more than one direction of bowing, said sub-harmonic tone generator comprising:

transducer means responsive to vibrations of a bowed vibrating element in a plane determined by a direction of bowing and producing a transducer signal, fundamental frequency detection means responsive to a fundamental frequency of said transducer signal and producing a signal indicative of said fundamental frequency, means to produce a signal indicative of the direction of said bowing.

first frequency divider means producing a first sub-harmonic control signal at a first sub-multiple of said fundamental frequency of said transducer signal.

means responsive to said signal indicative of the direction of said bowing for maintaining a constant phase relationship between said transducer signal and said first sub-harmonic control signal, irrespective of the direction of said bowing, first transducer signal gating means responsive to said first sub-harmonic control signal and producing a first sub-harmonic transducer signal at said first sub-multiple of said fundamental frequency of said transducer signal, second frequency divider means producing a second sub-harmonic control signal at a second sub-multiple of said fundamental frequency of said transducer signal, means responsive to said signal indicative of the direction of said bowing for maintaining a constant phase relationship between said transducer signal and said second sub-harmonic control signal, irrespective of the direction of said bowing, means to combine said first and said second sub-harmonic control signals and produce a composite sub-harmonic control signal, and second transducer signal gating means responsive to said composite sub-harmonic control signal and producing a second sub-harmonic transducer signal at said second sub-multiple of said fundamental frequency of said transducer signal, whereby each of said first and said second sub-harmonic transducer signals has a tone color which is effectively independent of the direction of said bowing.

7. The sub-harmonic tone generator of claim 6 wherein a said means for maintaining said constant phase relationship comprises means to maintain a constant phase relationship between said transducer signal and said signal indicative of said fundamental frequency of said transducer signal.

8. The sub-harmonic tone generator of claim 6 wherein said transducer signal and a said sub-harmonic transducer signal may be combined in any ratio without mutually cancelling each other.

9. The sub-harmonic tone generator of claim 6 further comprising high-pass filter means for producing a filtered transducer signal, whereby a said transducer signal gating means produces a filtered sub-harmonic transducer signal emulative of a tone signal produced by a musical instrument other than said bowed musical instrument and having a frequency range lower than said transducer signal and determined by a said sub-multiple of said fundamental frequency of said transducer signal.

10. The sub-harmonic tone generator of claim 6 further comprising:

means responsive to said transducer signal for producing a gate-enabling signal, and means to control a said transducer signal gating means with a said sub-harmonic control signal and said gate-enabling signal, whereby a said transducer signal gating means produces only a said sub-harmonic transducer signal.

* * * * *